US006706347B1

(12) United States Patent
Kürzinger et al.

(10) Patent No.: US 6,706,347 B1
(45) Date of Patent: Mar. 16, 2004

(54) CONTAINER FOR ANIMAL FEED

(75) Inventors: Hubert Kürzinger, Melle (DE); Dietmar Kuhlmann, Stadthagen (DE)

(73) Assignee: Tetra Holding (US), Inc., Blacksburg, VA (US)

( * ) Notice: Subject to any disclaimer, the term of this patent is extended or adjusted under 35 U.S.C. 154(b) by 0 days.

(21) Appl. No.: 10/069,812

(22) PCT Filed: Aug. 4, 2000

(86) PCT No.: PCT/EP00/07584

§ 371 (c)(1),
(2), (4) Date: Jun. 11, 2002

(87) PCT Pub. No.: WO01/14134

PCT Pub. Date: Mar. 1, 2001

(30) Foreign Application Priority Data

Aug. 26, 1999 (DE) ..... 199 40 592

(51) Int. Cl.[7] ..... B32B 27/36
(52) U.S. Cl. ..... 428/35.9; 53/170; 428/458
(58) Field of Search ..... 428/35.9, 458; 53/170, 174

(56) References Cited

U.S. PATENT DOCUMENTS 4,131,200 A 12/1978 Rinfret ..... 206/484
4,795,665 A * 1/1989 Lancaster et al. ..... 428/34

FOREIGN PATENT DOCUMENTS

| | | |
|---|---|---|
| DE | 8708305 | 12/1987 |
| DE | 3915635 | 11/1990 |
| DE | 4030646 | 4/1992 |
| DE | 9409937 | 6/1994 |
| EP | 0276908 | 8/1988 |
| EP | 0494582 | 7/1992 |
| JP | 61002555 | 1/1986 |
| WO | 9912430 | 3/1999 |

* cited by examiner

*Primary Examiner*—Sandra M. Nolan
(74) *Attorney, Agent, or Firm*—Merchant & Gould, P.C.

(57) ABSTRACT

A packing for animal feed is described which consists of a three-layer foil, whereby an aluminium foil is coated on one side with polyethylene terephthalate and on the opposite-lying side with chlorinated polypropylene.

12 Claims, 3 Drawing Sheets

Figure 4:
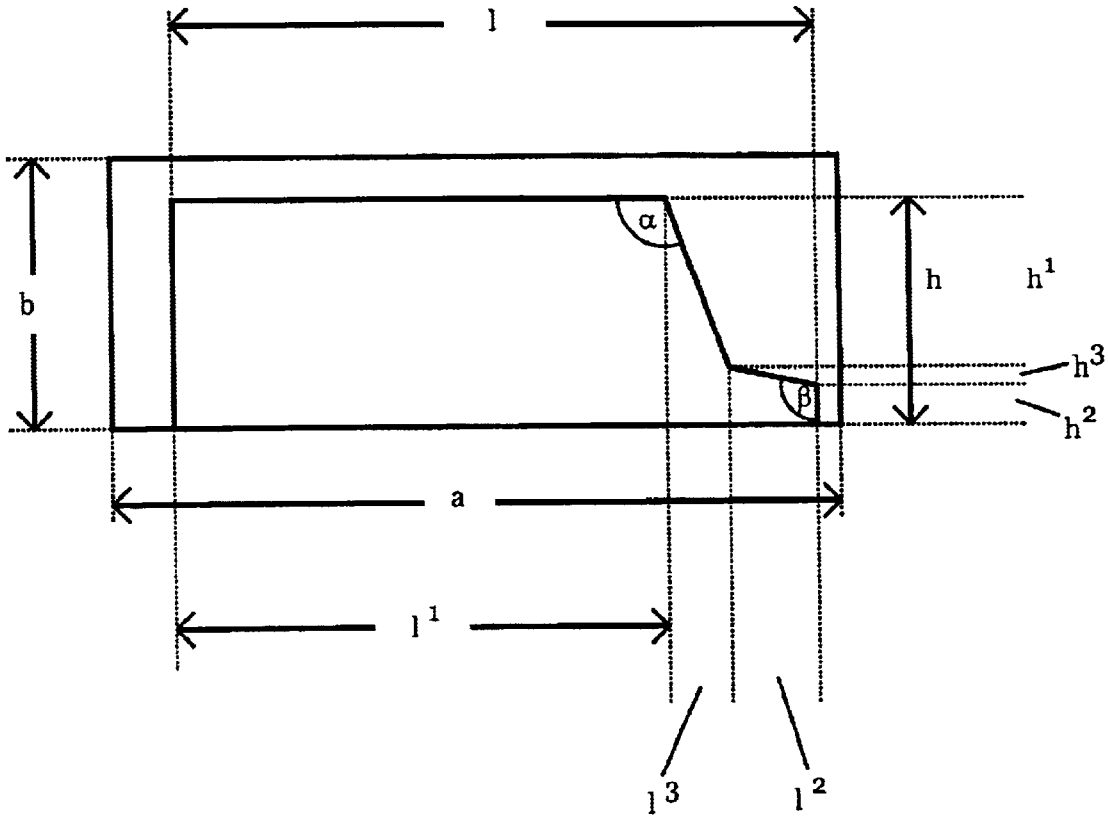

FIG.1
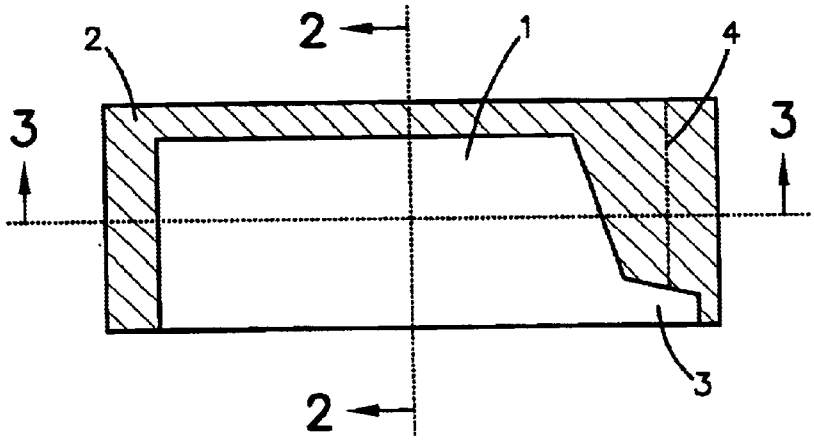
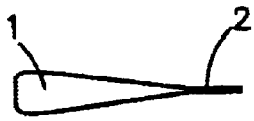
FIG.2
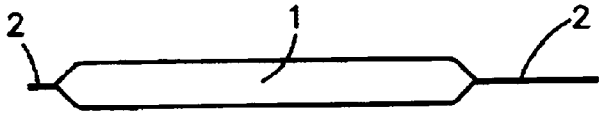
FIG.3

CONTAINER FOR ANIMAL FEED

The invention concerns a packing for animal feed.

For the feeding of animals, especially aquatic animals, in aquaria, there can, in principle, be used living feed, freeze-dried natural feed, frozen feed and dried feed. In the form of frozen feed, to warm and cold water ornamental fish in fresh and sea water aquaria are fed e.g. saline crayfish, krill, water fleas, stream flea crayfish, sludge tube worms, red and white gnat larvae, zooplankton, fish roes or calf heart. Specialised aquariarists often exclusively use living feed, freeze-dried natural feed and/or frozen feed. However, the preponderant majority of aquariarists administer dried feed, thus flakes, extrudates, tablets or pellets, in part in combination with the other types of feed. As packing for dried feed, there are, above all, used comparatively small containers of glass or synthetic material with reclosable lid.

From WO 99/12430 is known a feed for aquatic animals which is present in the form of a viscous gel. The gel-like feed is especially suitable for warm and cold water ornamental fish in the aquarium and can be used as replacement for frozen feed. However, in the case of this feed, the problem exists of an extreme susceptibility to microbiological decomposition. The feed consists of about 82% water, the remainder are predominantly protein carriers which can be microbiologically burdened. Therefore, for the preservation, there comes into question a pasteurisation process only in combination with preserving materials. However, the usual preserving agents show a very negative influence on the eating behaviour, especially of fish (poor acceptance). In addition, many of the preserving agents are only effective in acid medium, whereby the product smell is falsified which again leads, to a poor acceptance.

The containers of glass or synthetic material known as packing for dried feed come into question as packing for the gel-like feed described in WO 99/12430 just as little as, for example, heat-sterilisable portion packings of aluminium foil as find use e.g. for milk or marmalade. These packings have proved to be unsuitable in the case of use as animal feed packing. Disadvantageous in these packings is, inter alia, that the feed must be removed with a spoon since a portioning of the feed without further aids is not possible. The feed removal in this way proves to be of little attractiveness for fish since in water it rapidly sinks to the bottom.

The use of packings of special foils, as are known for mustard and ketchup portion packings, would be conceivable. However, with regard to the use as packing for animal feed, these foils display several disadvantages. On the one hand, they possess a very poor opening behaviour in the case of tearing open by hand, on the other hand the said packings are not heat-sterilisable, as well as only limitedly impermeable for oxygen. However, sterilisability by heat is an indispensable prerequisite for animal feed packings when a sufficient keeping of the feed is to be achieved. A minimum keeping of e.g. two years, is not achievable by a pasteurisation process alone.

A sterilisation process with avoidance of microbiologically effective preservation agents shows, in comparison with a pasteurisation process, the advantage of a better acceptance of the feed by the animals, a shortening of the processing time necessary for the preservation and the ensuring of a minimum keeping of two years.

Furthermore, suitable animal feed packings must display a high oxygen impermeability, as well as light impermeability. This is necessary because the fats contained in the animal feed are oxidised by oxygen which leads to rancidity, whereas vitamins of the animal feed are decomposed by the incidence of light. However, materials with a sufficient impermeability for oxygen display an increasingly poor flexibility. These packings can thereby not be satisfactorily pressed out, which represents a disadvantage especially in the case of the portioning of small amounts of feed.

As a further requirement for animal feed packings is to be mentioned a smallest possible-water permeability of the packing. A drying out of the feed is thereby prevented.

A packing for animal feed, especially aquatic animal feed, is to be provided which, besides a sufficient storability, also ensures an easy handling and portioning of the feed. According to the invention, this task is solved by the packing for animal feed according to independent patent claim 1, the process according to independent patent claim 7 and the use according to independent claim 9.

The packing for animal feed according to the invention consists of a foil which is produced by lamination of three different foils. By "lamination" is generally to be understood the pressing together or rolling of two or more foil strips to give a multi-layer, thicker foil strip. The placing together of the foils can thereby take place by temperature increasing in the case of the pressing or rolling and/or by addition of adhesive.

The packing according to the invention consists of a three-layered foil, namely, of a foil consisting of chlorinated polypropylene (Cpp), of an aluminium. foil and of a foil of polyethylene terephthalate (PETP). These 3 foils are connected by the above-described "laminating" to give a three-layered foil, whereby the aluminium foil stands in contact with the other two foils, thus the aluminium foil forms the middle layer. In the following, for the sake of simplicity, this three-layered foil is designated as an aluminium foil coated on both sides. Thus, this aluminium foil is coated on the side standing in contact with the animal feed with chlorinated polypropylene (Cpp) and on the opposite-lying side with polyethylene terephthalate (PETP).

The thickness of the three-layered foil amounts to between 20 and 200 $\mu$m, whereby the coating with polyethylene terephthalate has a thickness between 4 and 40 $\mu$m, the aluminium foil a thickness between 3 and 30 $\mu$m and the coating with chlorinated polypropylene a thickness between 13 and 130 $\mu$m. A foil is preferred with a thickness between 40 and 100 $\mu$m, especially between 52 and 70 $\mu$m, whereby the coating with polyethylene terephthalate has a thickness between 8 and 20 $\mu$m, especially between 10 and 14 $\mu$m, the aluminium foil a thickness between 6 and 15 $\mu$m, especially between 7 and 11 $\mu$m and the coating with chlorinated polypropylene a thickness between 26 and 65 $\mu$m, especially between 35 and 45 $\mu$m. Quite espesially preferred is a foil, the thickness of which amounts to about 61 $\mu$m, whereby the coating with polyethylene terephthalate has a thickness of about 12 $\mu$m, the aluminium foil a thickness of about 9 $\mu$m and the coating with chlorinated polypropylene a thickness of about 40 $\mu$m.

The described foil can be heat-sterilised, displays a sufficient impermeability for oxygen and possesses a sufficient flexibility. Due to the outstanding suitability of the foils for sterilisation by heat, as well as the excellent properties as oxygen barrier, the storage stability of gel-like feed according to WO 99/12430 of two years is achieved. This excellent keeping is achieved in spite of the omission of microbiologically-effective preservation agents, such as calcium propionate, potassium sorbate, citric acid, lactic acid, common salt or sea salt. The good flexibility of the foil ensures an easy ability to be pressed out and thus simple portionability of the feed also in the case of a small feed portion per packing of between 1 and 15 g, thus especially of small amounts, such as 2 to 4 g. The packing content can be divided up into still smaller portions due to the easy ability to be pressed out.

Especially having regard to the portionability but also, quite generally, for the simplified handling, the packing according to the invention-can find use in a special external form. A piece of the three-layered foil, shaped as desired, is, for this purpose, bent uniformly through 180° so that two sides coated with Cpp come to lie on one another. The bending does not take place with especial intensity since no kink may arise in the foil, on the contrary a hollow space is to be formed which serves for the reception of the animal feed. This hollow space is closed in its outer region by heat sealing, thus by pressing at elevated temperature, of the two foil layers.

According to the invention, the hollow space has a bottle neck-like extension. The heat-sealed part of the foil is so perforated that, in the case of opening by hand, an opening is formed transversely to the bottle neck-like extension. The three-layered foil can be exactly separated off along the perforated indentation by hand with two parallel tear-off edges and thereby forms an opening in the hollow space which is so dimensioned that a thin, worm-shaped feed strand can be pressed out.

The advantage of this manner of portioning of the animal feed is especially clear when the feed is used for aquatic animals in fresh and sea water, especially fish, shrimps and other invertebrates. If the feed is to be made available not only for surface fish and for fish of the middle zones as well as for bottom fish and other bottom-living forms of life, then the feed must, namely, float long enough on the top in order to allow the surface fish to become satisfied, it must float long enough in the water in order to satisfy fish of the middle zones and it must sink in compact state at the right speed in order to be fully taken up by bottom fish.

The above-described worm-shaped feed strand displays precisely these properties. Beside the fact that, on the basis of its properties, it remains stable and does not dissolve immediately, in addition it sinks only relatively slowly and, in this way, possesses sufficient attractiveness for all aquarium inhabitants. Besides the density of the aquatic animal feed, for these properties the cross-section in the direction of sinking of the feed portion also naturally also plays a decisive part. A slow sinking can then only be achieved when the feed portion has a relatively large cross-section in the direction of sinking since the flow buoyancy then counters sufficiently. An optimum relationship is achieved by the pressing out from the bottle neck-like elongation of the hollow space of the packing according to the invention.

Various forms of application are realisable with the bottle neck-like elongation. Worm-shaped pieces of any desired length can be allowed to fall on the water surface. These pieces then sink to the bottom. By careful dosing, short worm-shaped pieces float for a comparatively long time on the water surface. A direct feeding of individual fish is possible in that one holds the bottle neck-like elongation under the water and doses the feed to the fish directly into the mouth.

In principle, the packing according to the invention can be used for all animal feed products, the storability of which can be prolonged by sterilisation. However, the main point of the present invention lies in an animal feed packing for aquatic animals in fresh and sea water, especially fish, shrimps and other invertebrates.

The invention is to be explained in more detail on the basis of an embodimental example in conjunction with the drawings.

They show

Figure 5:
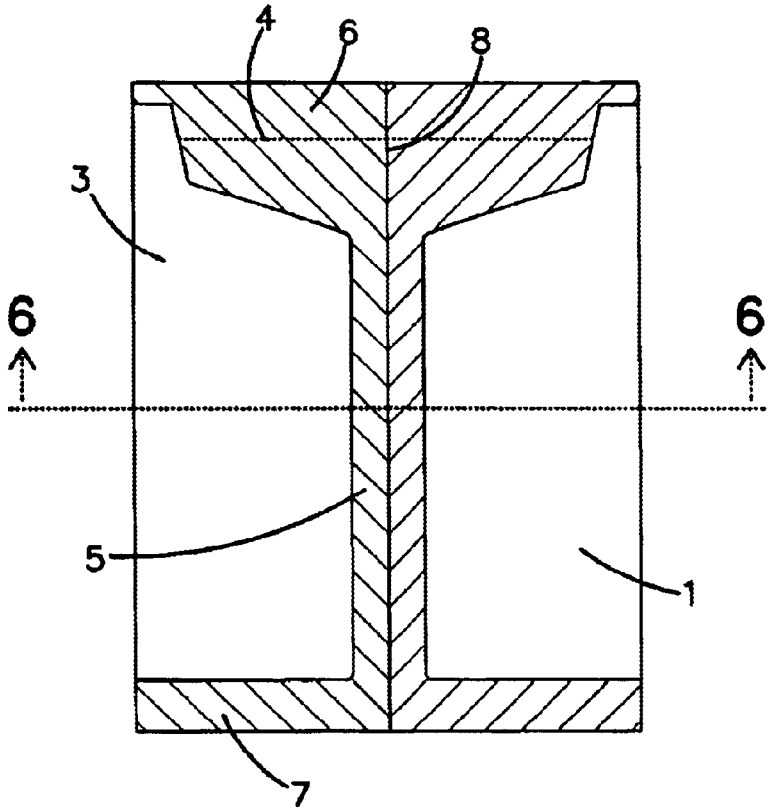
Figure 6:
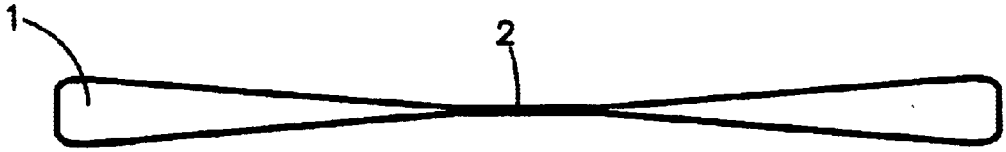

FIG. 1 a view of the packing according to the invention for animal feed;

FIG. 2 a section along the line 2 through FIG. 1 (viewing direction corresponds to the arrow direction in FIG. 1);

FIG. 3 a section along the line 3 through FIG. 1 (viewing direction corresponds to the arrow direction in FIG. 1);

FIG. 4 a packing for animal feed according to the invention;

FIG. 5 two connected animal feed packings;

FIG. 6 a section along the line 6 through FIG. 5 (viewing direction corresponds to the arrow direction in FIG. 5).

Various foils were investigated with regard to their suitability as packing material for animal feed. The foils used are summarised in Table 1:

| | |
|---|---|
| Foil A: | ET-$SiO_x$ (12 μm)/$SiO_x$-ET (12 μm)/PP (60 μm) |
| Foil B: | ET-$SiO_x$ (12 μm)/PP (60 μm) |
| Foil C: | ET (12 μm)/AL (9 μm)/ET (12 μm)/PE (60 μm) |
| Foil D: | PETP (12 μm)/AL (9 μm)/Cpp (40 μm) |

(ET: polyester; PP: polypropylene; PE: polyethylene; AL: aluminium)

Packings were produced from foils A to D, filled with gel-like feed according to WO 99/12430 and sterilised at 121° C. for 20 minutes. The assessment of various foil materials took place according to the criteria guide in Table 2.

TABLE 2

| | |
|---|---|
| Appearance: | The packings are to be as form-stable as possible, thus after the sterilisation display no kinks or the like. |
| Tear behaviour: | The packings are to be opened manually with smallest possible use of force, whereby a clean tear edge and a form-stable feed outlet opening is to result. |
| Laminating of the foil strips: | The holding together of the individual foil strips with one another is, even after the sterilisation, to be as intensive and stable as possible. |
| Seal seams: | The packings are to be leakproof on the sealing seams. |
| Foil thickness: | The feed dosing from the packing is to be realisable as simply as possible. |
| Feed forming: | The animal feed is to emerge from the packing in a strand which shows a certain similarity with a worm. |
| Oxygen permeability: | The oxygen permeability is to be as small as possible since fats contained in the feed are oxidised by oxygen. |
| Light protection: | The light protection is to be as strong as possible since vitamins contained in the feed are destroyed by light incidence. |

The results of the investigations are summarised in Table 3.

TABLE 3

| | Foil A comparison) | Foil B comparison) | Foil C comparison) | Foil D comparison) |
|---|---|---|---|---|
| appearance | −− | − | 0 | + |
| tear behaviour | −− | − | − | + |
| lamination of the foil strips | + | + | −− | + |
| seal seam | + | + | + | ++ |
| foil thickness | − | + | − | ++ |
| feed strand formation | − | 0 | 0 | ++ |
| oxygen permeability | 0 | 0 | + | + |
| light protection | − | − | + | + |

(++: very good; +: good; 0: average; −: poor; −−: very poor)

From Table 3, it is clear that the foil D, thus the aluminium foil (9 μm) coated with polyethylene terephthalate (12 μm) and chlorinated polypropylene (40 μm) optimally fulfils the requirements summarised in Table 2. The oxygen impermeability, as well as the light impermeability of the packing ensure an excellent protection of the feed since this gives satisfactory results not only against fat oxidation by oxygen but also against vitamin decomposition by light incidence. Furthermore, the foil D shows only a small permeability for water, whereby the drying out of the feed is prevented.

The foil C shows considerable weakness in the lamination of the foil strips which express themselves in that the aluminium layer detaches itself from the other foil layers. The foils A and B were strongly creased after the thermal treatment. The packings can only be opened with considerable application of force, whereby an untidy tear edge resulted and the product outlet opening was deformed.

In FIG. 1 is shown a preferred embodimental form of the packing for animal feed according to the invention. The packing consists of two layers of a three-layer foil, whereby the sides coated with chlorinated polypropylene lie opposite one another. The outer side of the aluminium foil is coated with polyethylene terephthalate. The thickness of the foil amounts to about 61 μm, whereby the coating with polyethylene terephthalate has a thickness of about 12 μm, the aluminium foil has a thickness of about 9 μm and the coating with chlorinated polypropylene has a thickness of about 40 μm.

The packing consists essentially of a hollow space (1) which serves for the reception of the aquatic animal feed. The hollow space (1) is bounded by a region (2) in that the two foil layers are securely bound with one another by heat sealing, thus by pressing at elevated temperature. FIG. 2 shows a section along the line II in FIG. 1. From FIG. 2, it is clear that the hollow space (1) is not limited by two separate foils but that, on the contrary, a foil is so arranged over itself that the sides of the foil coated with Cpp lie opposite one another. The two layers of the foil are firmly bound with one another in the region (2) and thus limit the hollow space (1).

FIG. 3 shows a section along the line III in FIG. 1. From FIG. 3 are also to be seen the foil layers firmly connected with one another in the region (2), as well as the hollow space (1) lying therebetween.

The hollow space (1) can have any desired form which, however, has a bottle neck-like elongation (3) on at least one place (FIG. 1). A perforation (4) is so stamped in the heat-sealed part (2) of the packing that, in the case of opening by hand by tearing along the perforation (4) in the bottle neck-like elongation (3), an opening is formed. Through this opening, the animal feed can be pressed in a simple way in the form of a worm-like strand from the hollow space (1).

According to the preferred embodimental form illustrated in FIG. 1, the packing for animal feed according to the invention possesses a substantially rectangular form. Depending upon its dimensioning, the hollow space of the packing is suitable for the reception of any desired amount of animal feed. Preferably, however, the hollow space possesses a volume which is suitable for the reception of one portion amount of animal feed. It is thereby a question of an amount of between 1 and 15 g of animal feed, preferably of 2 to 4 g of animal feed. The embodimental example shown in FIG. 4 is suitable for the reception of 3 g of animal feed which represents the quite especially preferred embodimental form of the present invention.

For reasons of material saving, the packing according to the invention has a smallest possible region (2) in which the two foil layers are bound with one another. However, the region (2) must have at least such an elongation that an unintentional opening of the packing on a position other than along the perforation (4) provided therefor is prevented.

In FIG. 4 is shown the dimensioning of the packing preferred according to the invention. The packing has a length a and a breadth b. The hollow space (1) has a length l and a breadth h, whereby the hollow space consists of a rectangular region of the length l, and of the breadth h and a bottle neck-like elongation (3) of the length $l_2$ and breadth $h_2$, whereby the bottle neck-like elongation is connected by a trapezium-shaped transition region with the rectangular part of the hollow space. The trapezium-shaped transition region possesses, on the side facing the rectangular part of the hollow space, a breadth h, on that facing the bottle neck-shaped elongation a breadth $h_2+h_3$. The length of the trapezium-shaped transition region is designated with $l_3$.

For the clear description of the dimensioning, the angles β and β are entered in FIG. 4. The angle α lies between the limitation of the length l, of the rectangular part of the hollow space which faces the region in which the two foil layers are securely bound with one another and the limitation of the breadth $h_2$ of the trapezium-shaped transition region. The angle lies between the limitation of the bottle neck-like elongation which faces away from the rectangular part of the space and the limitation of the bottle neck-like elongation which does not coincide with the outer limitation of the packing.

In the preferred embodimental form according to the invention, a, b, l, $l_1$, $l_2$, $l_3$, h, $h_1$, $h_2$, $h_3$, α and β can assume the following values:

$30\ mm \leqq a \leqq 150\ mm$, especially $40\ mm \leqq a \leqq 90\ mm$;

$10\ mm \leqq b \leqq 40\ mm$, especially $15\ mm \leqq b \leqq 28\ mm$;

$21\ mm \leqq l \leqq 140\ mm$, especially $35\ mm \leqq l \leqq 80\ mm$;

$20\ mm \leqq l_1 \leqq 120\ mm$, especially $32\ mm \leqq l_1 \leqq 70\ mm$;

$1\ mm \leqq l_2 \leqq 15\ mm$, especially $2\ mm \leqq l_2 \leqq 7\ mm$;

$0\ mm \leqq l_3 \leqq 5\ mm$, especially $1\ mm \leqq l_3 \leqq 4\ mm$;

$12\ mm \leqq h \leqq 35\ mm$, especially $15\ mm \leqq h \leqq 25\ mm$;

$11\ mm \leqq h_1 \leqq 24\ mm$, especially $13\ mm \leqq h_1 \leqq 18\ mm$;

$1\ mm \leqq h_2 \leqq 8\ mm$, especially $1\ mm \leqq h_2 \leqq 5\ mm$;

$0 \leqq h_3 \leqq 3\ mm$, especially $1\ mm \leqq h_3 \leqq 2\ mm$;

$90° \leqq \alpha \leqq 130°$, especially $100° \leqq < \alpha \leqq 120°$;

$90° \leqq \beta \leqq 130°$, especially $100° \leqq \beta \leqq 120°$ whereby the conditions apply $l_3 \leqq l_2 \leqq l_1$;

$h_3 \leqq h_2 \leqq h_1$;

$l_1+l_2+l_3=l$;

$h_1+h_2+h_3=h$.

For the case $\alpha=\beta=90°$, the packing does not have a trapezium-shaped transition region. For $\alpha \leqq 90°$, there is given a pointed corner of the hollow space (1) which, having regard to the easy ability to be pressed out of the animal feed, acts disadvantageously since residues of the feed can remain behind in it. $\beta \leqq 90°$ also appears unsuitable since the bottle neck-like elongation has, in this case, a narrow place which also proves to be disadvantageous in the case of the pressing out of the feed.

The preferred embodimental form of the present invention displays the dimensions $a \approx 85$ mm, $b \approx 24$ mm, $l \approx 78$ mm, $l_1 \approx 66$ mm, $l_2 \approx 6$ mm, $l_3 \approx 3$ mm, $h \approx 20$ mm, $h_1 \approx 14$ mm, $h_2 \approx 5$ mm, $h_3 \approx 1$ mm, $\alpha \approx 110°$, as well as $\beta \approx 110°$.

However, it should again be stressed that not only the packing but also the hollow space for the reception of the aquatic animal feed can, according to the invention, show any desired form. The sole limitation of the choice of the form is the presence of the bottle neck-like elongation (3) which supports the advantageous properties of the pressed-out, worm-like feed strand.

For the expert, the fact is self-evident that the hollow space formed by the two foil layers has, in every case, a volume going somewhat beyond the volume of the aquatic animal feed contained therein. Thus, the hollow space (1) is not completely filled with animal feed since, in this case, an increased danger exists of the undesired bursting of the packing.

For the production of the animal feed packing, from the three-layered foil are produced two three-edge sealed bags (see FIG. 5) hanging together in longitudinal direction. For this purpose, both foil edges are displaced through 180° with the help of a forming shoulder so that both foil edges meet in the middle of the foil (FIG. 6). With a format tool takes place the heat sealing of initially two seams, the longitudinal seam (5) and the top seam (6). By means of the top seam (6), the delivery geometry of the animal feed packing is determined. The breadth of the hollow space (1) is reduced by the format tool to a bottle neck-like or also a tube-like elongation (FIG. 5). Parallel to the sealing takes place the filling of the packing via a filling pipe. Subsequently, the bottom is sealed in the region (7). Thereafter takes place the perforation (8) on the longitudinal seam as tear-off help for the separation of the bag pair and the perforation (4) on the head as tear-off help. Subsequently, the bag pair is separated from the following bag pair.

In principle, all animal feed products, the stability of which is prolongable by sterilisation, can be filled into the animal feed packing according to the invention. The main focus of the present invention lies on an animal feed packing for aquatic animals in fresh and sea water, especially fish, shrimps and other invertebrates.

What is claimed is:

1. A container for animal feed comprising a three-layer foil, whereby the foil consists of an aluminum foil which is coated with chlorinated polypropylene on the side standing on contact with the animal feed and on the opposite lying side with polyethylene terephthalate.

2. A container according to claim 1, wherein the thickness of the three-layered foil is between about 20 μm and 200 μm, the coating with polyethylene terephthalate has a thickness between about 4 μm and 40 μm, the aluminum foil a thickness between 3 μm and 30 μm, and the coating with chlorinated polypropylene a thickness between 13 μm and 130 μm.

3. A container according to claim 1, wherein the three-layer foil has a thickness between about 40 μm and 100 μm, the coating with polyethylene terephthalate has a thickness between 8 μm and 20 μm, the aluminum foil a thickness between 6 μm and 15 μm, and the coating with chlorinated polypropylene a thickness between 26 μm and 65 μm.

4. A container according to claim 1, wherein the three-layer foil amounts to between 52 μm and 70 μm, the coating with polyethylene terephthalate has a thickness between 10 μm and 14 μm, the aluminum foil has a thickness between 7 μm and 11 μm, and the coating with chlorinated polypropylene has a thickness between 35 μm and 45 μm.

5. A container according to claim 4, wherein the three-layer foil amounts to 61 μm, the polyethylene terephthalate coating has a thickness of 12 μm, the aluminum foil has a thickness of 9 μm, and the coating with chlorinated polypropylene has a thickness of about 40 μm.

6. A container according to claim 1, wherein two layers of the three-layered foil has a hollow space (1) formed for the reception of the animal feed, whereby the hollow space (1) has a bottle neck-like elongation (3).

7. A container according to claim 6, wherein the container has a substantially right-angular shape and the two layers of the three-layered foil are firmly connected with one another in the outer region (2) of the container.

8. A container according to claim 7, herein the two foil layers firmly connected with one another are provided with a perforation (4) in a region neighboring the bottle neck-like elongation (3).

9. A process for the production of a container for animal feed, comprising folding a three-layered foil according to claim 1 so that it is arranged over itself in such a manner that two sides coated with chlorinated polypropylene lie opposite one another and the two layers of the three-layered foil are firmly connected with one another in the outer region (2) of the container by heat sealing, whereby a hollow space (1) is formed for the reception of the animal feed with a bottle neck-like elongation (3).

10. The process according to claim 9, whereby the two foil layers firmly connected with one another are perforated in a region (4) neighboring the bottle neck-like elongation (3).

11. A method for feeding aquatic animals in fresh and sea water comprising applying said feed through a container according to claim 1.

12. The method according to claim 11, wherein the aquatic animals are fish, shrimp, and other invertebrates.

* * * * *